United States Patent [19]

Bontenbal et al.

[11] Patent Number: 4,911,199

[45] Date of Patent: Mar. 27, 1990

[54] PILOT OPERATED SAFETY VALVE

[75] Inventors: Pieter J. Bontenbal, Rijswijk; Sietse Bousema, Assen, both of Netherlands

[73] Assignee: Shell Internationale Research Maatschappij B.V., The Hague, Netherlands

[21] Appl. No.: 344,567

[22] Filed: Apr. 28, 1989

[30] Foreign Application Priority Data

Apr. 28, 1988 [GB] United Kingdom ..... 8810100

[51] Int. Cl.[4] ..... E21B 33/00

[52] U.S. Cl. ..... 137/460; 137/487

[58] Field of Search ..... 137/460, 461, 462, 487

[56] References Cited

U.S. PATENT DOCUMENTS

| | | | |
|---|---|---|---|
| 2,160,766 | 5/1939 | Thomason | 137/460 |
| 2,590,918 | 4/1952 | Barnes | 137/462 |
| 3,400,734 | 9/1968 | Rosenberg | 137/460 X |
| 4,708,163 | 11/1987 | Deaton | 137/460 |

*Primary Examiner*—Alan Cohan

*Attorney, Agent, or Firm*—Jones, Tullar & Cooper

[57] ABSTRACT

A safety valve of the type having a valve body which is closed in response to an excess flow of fluid comprises a pilot piston which causes a sudden increase of the pressure in a cavity around the lower end of the valve stem if the pressure difference across the valve reaches a preset value, thereby controlling the valve such that is closes at a well defined setting point.

10 Claims, 1 Drawing Sheet

PILOT OPERATED SAFETY VALVE

The invention relates to a pilot operated safety valve for preventing excess flow through a tube.

Safety valves which are closed by an excess flowrate of fluid are generally useful where it is desired to insure that the flowrate of fluid through the tube does not exceed a predetermined maximum.

Safety valves of this type are particularly useful for installation in a tubing via which oil and/or gas is produced from a well.

In producing such wells it is known that the flowrate in the production tubing should be maintained below a certain maximum to insure safe operation and to avoid ingress of water and sand into the well. It is therefore important that some means for automatically shutting off an excess flow of fluid through the well be provided.

To this end it is already known to install safety valves comprising a valve body which is kept open at normal flowrates of fluid, but which is closed when the pressure in the vicinity of the valve body decreases as a result of an increase of velocity of the fluid passing through the valve. Safety valves of this type are disclosed, for example, in U.S. Pat. No. 2,590,918 and in British patent specification No. 1,309,562.

Although the known safety valves operate satisfactory in many wells it has been found that the flowrate at which the valve closes may vary within a certain range.

The safety valve according to the invention is intended to remedy this drawback of known excess flow safety valves.

Accordingly it is an object of the present invention to provide a safety valve which closes at a well defined setting point.

The safety valve according to the invention comprises:

- a valve body which is kept open at normal flowrates of the fluid in the tubing and which is closed when the pressure in the vicinity of the valve body decreases as a result of an increase of velocity of the fluid passing through the valve,
- a valve stem secured at one end thereof to the valve body, said valve stem being slidably arranged at its other end in a cavity such that it slides at least partly out of said cavity if the valve body moves towards its closed position,
- a pilot piston which is movable between a position in which it opens a first fluid passage extending between said confined space and the valve bore downstream of the valve body and another position in which it closes the former passage and simultaneously opens a second fluid passage extending between said confined space and the tubing interior upstream of the valve body,
- a first fluid chamber surrounding a first end of the piston, said first chamber being connected in fluid communication with said first fluid passage, and
- a second fluid chamber surrounding a second end of the piston, said second chamber being connected in fluid communication with said second fluid passage.

Field tests indicated that the pressure differential across the valve at which the pilot piston switches can be accurately set. In response to the switching of the pilot piston the relatively high pressure at the upstream side of the valve body is transferred to the cavity surrounding an end of the valve stem, whereupon the valve body is moved towards its closed position by the differential pressure over the valve caused by the flowing fluid.

It is preferred to provide the valve with snap acting spring means which push during normal operation of the valve, in the absence of an excess flow, the pilot piston towards said one position in which the first fluid passage is kept open. Preferably the spring force exerted by the snap acting spring means to the pilot piston is adjustable in such a manner that the spring force decreases if a certain force is applied to the pilot piston as a result of the pressure difference between the first and second fluid chamber.

These and other features and advantages of the safety valve according to the invention will now be explained in more detail with reference to the accompanying drawing, in which.

Figure 1:
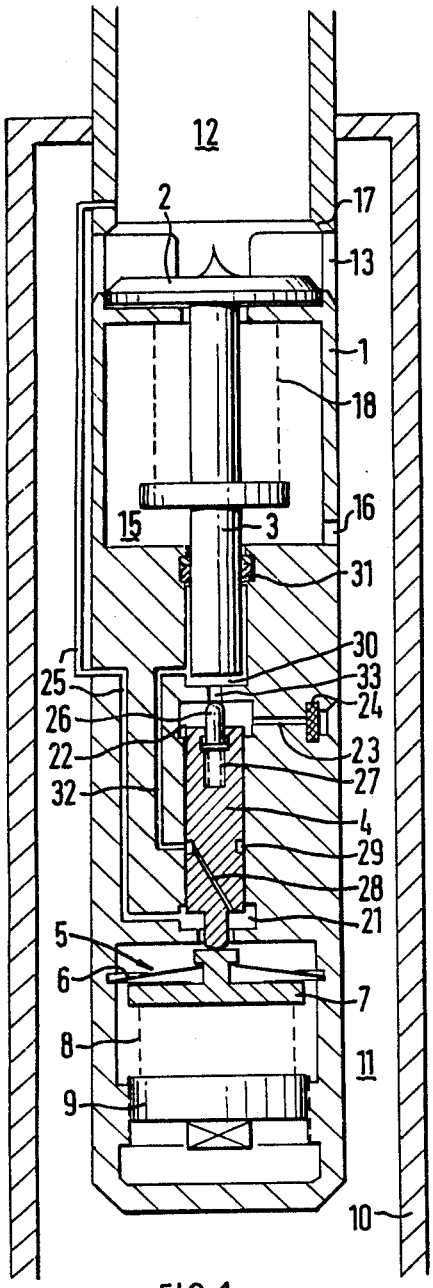
FIG. 1 shows a sectional view of a safety valve in the open position.
Figure 2:
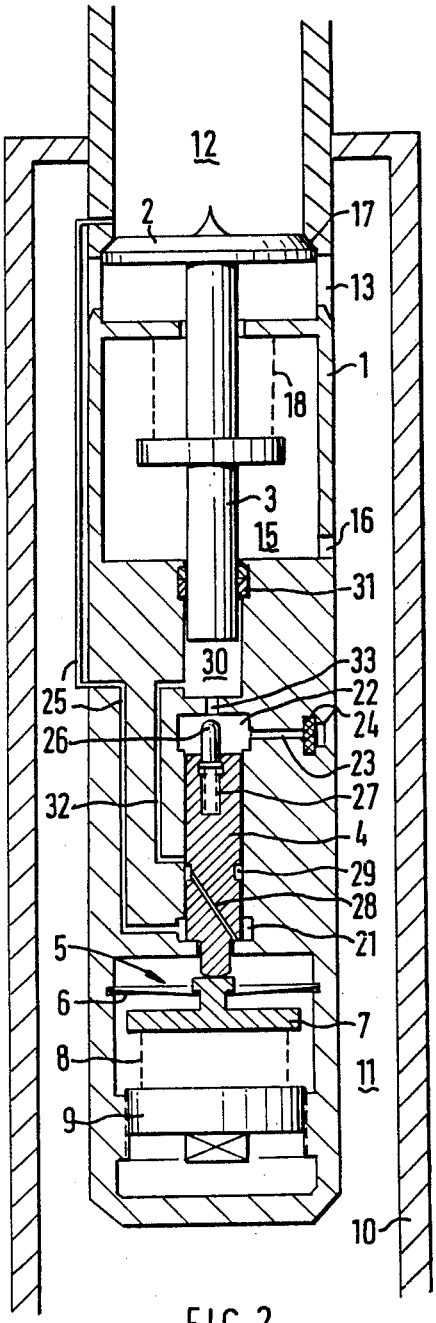
FIG. 2 shows a sectional view of the safety valve of FIG. 1, but in the closed position.

Referring to both FIGS. 1 and 2 a pilot operated safety valve is shown comprising a valve housing 1, a valve body 2 mounted on a valve stem 3, a pilot piston 4 and snap acting spring means 5. The snap acting spring means 5 consist of a snap spring disc 6, an actuator body 7, a helicoil adjustment spring 8 and an adjustment nut 9.

The valve housing 1 is inserted in a tubing 10 such that in use fluid flows alongside the housing 1 via an annular space 11 and enters the valve bore 12 via inlet ports 13. The inlet ports 13 are located in the vicinity of the valve body 2 whereas the upper part of the valve stem 3 is located in a space 15 which is in communication with the annular space 11 via pressure equalizing ports 16.

In this manner the fluid flowing in use of the valve through the ports 13 creates a pressure difference across the valve body 2, resulting in a force which tries to move the valve body 2 towards a valve seat 17 against the action of a reset spring 18.

The pilot piston 4 and snap acting spring means 5 are intended to control the valve closing in such a manner that the valve closes at a well defined flowrate of fluid. The pilot piston 4 is slidably arranged between a first fluid chamber 21 and a second fluid chamber 22.

The first fluid chamber 21 is connected to the valve interior at the downstream side of the valve body 2 by a low pressure fluid feed conduit 25. The second fluid chamber 22 is connected to the annular space 11 via a high pressure fluid feed conduit 23 in which a filter 24 is arranged.

The pilot piston 4 is equipped with a stem seal 26 which is slidably supported by a spring 27 in a recess in the upper end of the piston 4. A slant bore 28 is provided near the lower end of the piston for forming fluid communication between the first fluid chamber 21 and an annular groove 29 formed in the cylindrical side wall of the piston 4.

The lower part of the valve stem 3 is arranged within a cavity 30 which is hydraulically separated from the space 15 by a rod seal 31. Two pressure control lines 32 and 33 are connected to the cavity 30. The first pressure control line 32 forms together with the low pressure fluid feed conduit 25 the first fluid passage via which low pressure fluid may be fed from the valve bore 12 in the vicinity of the valve body 2 to the cavity 30. The second pressure control line 33 forms together with the high pressure fluid feed conduit 23 the second fluid passage via which high pressure fluid may be fed from the annular space 11 to the cavity 30.

The operation of the valve during normal flow conditions will now be explained with particular reference to FIG. 1, whereas the closure of the valve in response of an excessive flow of fluid will be explained with particular reference to FIG. 2.

As illustrated in FIG. 1 during normal operation of the valve the pilot piston 4 is pushed by the snap acting spring means 5 to the upper position thereof. The upward force exerted by the pressured difference between the high pressure fluid in the second fluid chamber 22 above the piston 4 and the low pressure fluid in the first fluid chamber 21 is insufficient to overcome the upward spring force exerted by the snap acting spring means 5 to the piston 4. When the pilot piston 4 is in the upper position the stem seal 26 seals off the second pressure control line 35 whereas the groove 29 in the piston 4 is located adjacent to the inlet of the first pressure control line 32, so that the cavity 30 is in fluid communication with the valve bore 12 downstream of the valve body 2. In this manner the low pressure is transferred from the valve interior 12 to the cavity 30 around the lower part of the valve stem 3.

During normal operation the downward force exerted to the valve body 2 and valve stem 3 by the pressure difference resulting from the relatively low pressure in the cavity 30 and by the spring 18 exceeds the upward force exerted thereto by the pressure difference across the valve body 2 and valve stem 3 resulting from the pressure drop in the fluid passing through the inlet ports 13.

It will be understood that the magnitude of the pressure differential between the annular space 11 and the valve bore 12 resulting from the flow resistance in the valve bore 12 is related to the mass flow through the valve and that said pressure differential has a relatively high and progressive characteristic. As a result thereof the force exerted by the fluid pressure on the pilot piston 4 will increase in response to an increase of the flowrate of the fluid passing through the valve.

If said flowrate reaches a predetermined value the following valve closure mechanism is activated.

The pressure differential between the second and first fluid chamber 22 and 21 will increase as a result of which the downward force on the pilot piston 4 increases. As soon as said downward force exceeds the upward force exerted by the snap acting spring means 5 the snap disc 6 switches from the upper position shown in FIG. 1 to the lower position shown in FIG. 2.

As a result of the downward movement of the piston 4 the annular groove 29 moves away from the inlet of the first pressure control line 32 so that the fluid passage between the valve bore 12 in the vicinity of the valve body 2 and the cavity 30 is closed, whereas the stem seal 26 moves away from the inlet of the second pressure control line 33 and thereby opens the fluid passage between the annular space 11 and the cavity 30.

As a consequence thereof high pressure fluid enters the cavity 30 and eliminates the lower pressure condition in the cavity, thereby neutralizing the hold down force acting on the valve stem 3. As a result the valve body 2 and valve stem 3 can now move upwards because the upward force generated by the differential pressure across the valve body 2 exceeds the downward force generated by the reset spring 18. When the valve body 2 starts moving upwards, it decreases the area of the inlet ports 13 and thus further increases the pressure differential across the valve body 2 and also the closing speed of the valve, with the result that the closing of the valve takes place approximately instantaneously once the valve body 2 starts moving upwards.

In view of the above it will be understood that the moment at which the actuator body 7 switches to its downward position triggers off the downward movement of the pilot piston 4 and the upward movement of the valve body 2. Said moment of the switching off actuator body 7 can be well-defined as the combined upward force exerted by the spring 8 and the snap disc 6 can be adjusted by the adjustment nut 9.

Laboratory testing of the valve according to the invention has shown that the setting point, i.e. the pressure difference across the pilot piston at which the piston shifts, can be accurately adjusted by means of the adjustment nut 9.

The setting point of the tested valve ranged from 4.5 bar to 23.5 bar and covers the requirements for many gas wells. If desired, the setting range of the valve can be further widened by installing a spring 8 with another characteristic.

Subsequent field trails of the valve revealed accurate valve closure in response to well flow in excess of the preset closure flowrate. The field trials furthermore revealed that the valve can be reset to its open position by equalizing the pressure across the valve.

It will be understood that the present invention is not limited to the design of the safety valve as shown in the drawing. Various parts of the valve may be of other design. Thus, the valve body may be pivotally connected to the valve housing, as is for instance the case when applying a flapper valve. Further the invention is not restricted to the valve actuator mechanism shown. For example the snap acting spring means 5 may be replaced by another snap acting mechanism.

We claim:

1. A pilot operated safety valve for preventing excess flow through a tube, the valve comprising:

a valve body which is kept open at normal flowrates of the fluid in the tubing and which is closed when the pressure in the vicinity of the valve body decreases as a result of an increase of velocity of the fluid passing through the valve, a valve stem secured at one end thereof to the valve body, said valve stem being slidably arranged at its other end in a cavity such that it slides at least partly out of said cavity if the valve body moves towards its closed position, a pilot piston which is movable between a position in which it opens a first fluid passage extending between said confined space and the valve bore at a location downstream from the valve body and another position in which it closes the former passage and simultaneously opens a second fluid passage extending between said confined space and the tubing interior upstream of the valve body, a first fluid chamber surrounding a first end of the piston, said first chamber being connected in fluid communication with said first fluid passage, and a second fluid chamber surrounding a second end of the piston, said second chamber being connected in fluid communication with said second fluid passage.

2. The safety valve of claim 1, further comprising snap acting spring means which exert during normal operation of the valve, when the valve body is kept open, a compression force to said first end of the pilot piston.

3. The safety valve of claim 2 wherein the snap acting spring means comprise an actuator body which is held in engagement with said first end of said pilot piston by the action of a snap disc and an adjustment spring which is held under a preset compression force by an adjustment nut which can be moved towards and away from the snap disc.

4. The safety valve of claim 1 wherein the pilot piston is provided at said second end thereof with a stem seal which closes off said second fluid passage if the pilot piston is located in said one position and which opens said second fluid passage if the pilot piston is located in said other position.

5. The safety valve of claim 1 wherein the pilot piston comprises a cylindrical wall in which an annular groove is machined, which groove is in fluid communication with said first fluid chamber via a bore in the piston and which is further in fluid communication with an end of a section of the first fluid passage if the piston is located in said one position, whilst the groove is moved away from said end of said section of the first fluid passage if the piston is located in said another position.

6. The safety valve of claim 1, comprising a tubular valve housing and a disc shaped valve body mounted on a cylindrical valve stem in the vicinity of a series of radial fluid inlet ports formed in the side wall of the housing, which inlet ports are closed off by the valve body when the pressure downstream of the valve body decreases as a result of an increase of velocity of the fluid passing through the valve.

7. The safety valve of claim 6 wherein said first fluid passage comprises a fluid inlet located in the vicinity of the valve body at a location downstream of said fluid inlet ports.

8. The safety valve of claim 4 wherein said second fluid passage comprises a radial section extending between the second fluid chamber and a space surrounding the valve housing and an axial section extending between the second fluid chamber and said cavity.

9. The safety valve as claimed in claim 1, substantially as described with reference to the accompanying drawing.

10. The safety valve of claim 6 wherein said second fluid passage comprises a radial section extending between the second fluid chamber and a space surrounding the valve housing and an axial section extending between the second fluid chamber and said cavity.

* * * * *